US006949067B1

(12) United States Patent
Dann et al.

(10) Patent No.: US 6,949,067 B1
(45) Date of Patent: Sep. 27, 2005

(54) DEVICE AND METHOD FOR ENHANCING FEMALE SEXUAL STIMULATION

(76) Inventors: Jeffrey A. Dann, 44 Terrace Dr., Worcester, MA (US) 01609; David Gloth, 16 Harcourt St., Apt. 61, Boston, MA (US) 02116

( * ) Notice: Subject to any disclaimer, the term of this patent is extended or adjusted under 35 U.S.C. 154(b) by 0 days.

(21) Appl. No.: 10/842,957

(22) Filed: May 11, 2004

(51) Int. Cl.[7] ..... A61F 5/00

(52) U.S. Cl. ..... 600/38

(58) Field of Search ..... 600/38–41, 29–32, 600/573–582; 128/883, 885, DIG. 25; 601/6, 601/7, 9–11, 13, 14, 84; 604/22

(56) References Cited

U.S. PATENT DOCUMENTS 5,813,973 A * 9/1998 Gloth ..... 600/29
6,464,653 B1 * 10/2002 Hovland et al. ..... 601/7
6,733,438 B1 * 5/2004 Dann et al. ..... 600/38

* cited by examiner

*Primary Examiner*—Samuel G. Gilbert
(74) *Attorney, Agent, or Firm*—Lowrie, Lando & Anastasi, LLP

(57) ABSTRACT

A female stimulation device and method for enhancing female sexual stimulation. The device includes a body having a tip portion, a flange, and an intermediate side wall portion. The intermediate side wall portion extending from the tip portion to the flange. The vacuum produced by the device when applied to a user can be controlled to enhance clitoral blood flow without causing clitoral injury.

56 Claims, 11 Drawing Sheets

DEVICE AND METHOD FOR ENHANCING FEMALE SEXUAL STIMULATION

BACKGROUND OF INVENTION

1. Field of Invention

The present invention relates generally to a device and method to increase female sexual stimulation and, more specifically, to a female stimulation device and method which provides vascular engorgement.

2. Description of the Related Art

Clitoral vascular engorgement plays an important role in female sexual arousal and satisfaction. Sexual arousal results in smooth muscle relaxation and arterial vasodilation within the clitoris. The resultant increase in blood flow leads to tumescence of the glans clitoris and increased sexual arousal. A variety of diseases, such as arteriosclerosis and diabetes, may cause clitoral erectile insufficiency and reduced clitoral arterial flow. This, in turn, may lead to difficulty or inability to achieve clitoral tumescence, especially in women who suffer from female sexual arousal disorder (FSAD). FSAD may be expressed as a lack of either subjective excitement, genital lubrication or orgasmic function.

The most effective method of increasing clitoral engorgement, especially in women suffering from FSAD, is through use of suction. A partial vacuum placed over the clitoris creates negative pressure in the organ which promotes clitoral arterial inflow and venus congestion and results in increased vascular engorgement and sexual arousal. One device for stimulating female sexual response that is designed to be applied in the clitoral region is described in U.S. Pat. No. 6,733,438, which is incorporated herein by reference in its entirety. It consists of a vacuum-producing, partially deformable device of unitary construction having a distal tip portion, a flange and intermediate side walls which, when placed over the clitoris of the user, stimulates blood flow and sexual response. The intermediate side walls are outwardly convex so as to retain its shape rather than collapse when vacuum is applied. The side walls may be reinforced with internal or external arches. The arched geometry prevents side wall collapse and clitoral compression with injury.

SUMMARY OF INVENTION

In accordance with one or more embodiments, the present invention can provide a female stimulation device. The device includes a body having a tip portion, a flange, and an intermediate side wall portion. The intermediate side wall portion extending from the tip portion to the flange. The device also includes means for controlling vacuum produced by the device when applied to a user.

In accordance with one or more embodiments, the present invention can also provide a method for facilitating female stimulation. The method includes providing a device comprising a tip portion, a flange, and an intermediate side wall portion extending outwardly from the tip portion to the flange. The flange is sized and shaped to encompass the female clitoris. The intermediate side wall portion is outwardly convex and defines a vacuum reservoir lower chamber. The tip portion is deformable and defines a vacuum producing upper chamber that produces vacuum levels of between about 40 and about 190 mmHg in the lower chamber. The method further includes providing instruction to apply the device to promote clitoral blood flow without causing injury to underlying tissue.

In accordance with one or more embodiments, the present invention can also provide a method for enhancing female stimulation. The method includes providing a female stimulation device comprising a tip portion, a flange, and an intermediate side wall portion extending from the tip portion to the flange and defining an interior vacuum chamber. The tip portion is compressed to reduce an air column formed within the interior vacuum chamber. The device is placed over the female clitoris such that the flange is placed into contact with anterior vaginal vault tissue. The tip portion is released to produce vacuum levels of between about 40 and about 190 mmHg in the interior vacuum chamber. The vacuum causes clitoral engorgement and maintains engagement of the device with the anterior vaginal vault tissue. The device may be removed after a predetermined period of time. The method may be repeated periodically to condition and treat genital tissues.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1A:
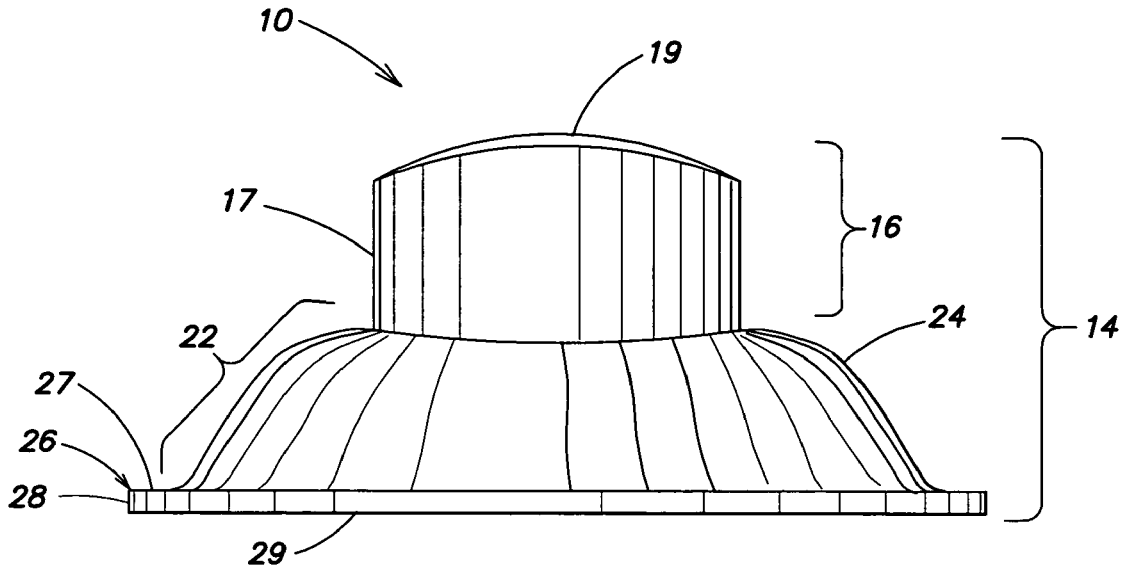
FIG. 1A is a side view of a female stimulation device in accordance with the invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

In accordance with one or more embodiments, a device for stimulating the clitoris of a female includes a resilient and at least partially deformable device body having an enclosed tip portion, a flange, and an intermediate side wall portion. The side wall portion may extend outwardly from the tip portion to the flange. The device body is sized to encompass the clitoris of the user and is of unitary construction. In use, the device body is placed over the clitoris of the user and the tip portion is deformed, causing a vacuum environment to be formed in an interior chamber formed by the device body. The vacuum environment maintains the device in reliable sealed engagement around the clitoris. A biocompatible lubricant, adhesive, or pharmacologically active material such as vasoactive agent, may be applied to the flange in order to enhance the vacuum seal and to further increase clitoral blood flow. The amount of lubricant or pharmacologically active material should be on the order of 3 mm thickness or less to avoid device slippage.

With this arrangement, a small, simple, and effective female clitoral stimulation device provides suction to the clitoris, thereby stimulating vascular engorgement and sexual arousal. Advantageously, the device does not require an external vacuum source or associated tubing or connections. The device is simple to use, permitting the user to perform her daily activities while wearing it in an undetectable and discreet fashion.

In some embodiments the intermediate side wall portion has an outwardly convex shape. With this geometry, the intermediate side wall portion is substantially non-deformable in response to deformation of the tip portion. In other words, the vacuum producing tip portion is deformable while the outwardly convex geometry of the intermediate side wall permits the lower chamber to retain its shape, serving as a soft, yet functionally non-deformable, vacuum reservoir. With this arrangement, the device may be of unitary construction, manufactured from a single, soft, deformable material, yet possess both deformable and non-deformable portions. Furthermore, the soft, deformable material comprising the functionally non-deformable lower chamber will form a substantially fixed volume lower vacuum chamber over the clitoris, thereby preventing side wall abutment with associated tissue compression to genital tissue. The soft flange will prevent pressure necrosis of genital tissue when compared to rigid, non-deformable materials.

In some embodiments, the device may be made disposable by constructing it from low-tear strength materials. The low-tear strength materials permit the device to easily tear apart after one or more applications. To further increase the disposability of the low-tear strength material, one or more slits can be made in the flange. In another embodiment, the device can be made disposable by including a biodegradable plug in the tip portion which would degrade upon contact with the moist vaginal tissue. Once dissolved, an open channel would connect the device's inner vacuum chamber to the outside, therefore destroying the vacuum-producing potential for the device. In another embodiment, a patch of material can be attached over a hole in the wall of the device. Upon multiple uses, the patch will tear away. In another embodiment, a portion of a wall of the device is constructed extremely thin so as to rupture upon multiple uses. Disposability enhances safety by avoiding infection or contamination.

In some embodiments a method for increasing female sexual stimulation includes placing on the clitoris of the user a device body having a tip portion, a flange and an intermediate side wall portion extending outwardly from the tip portion to the flange so that the device body encompasses the clitoris. The method further includes deforming the tip portion so as to create a vacuum chamber within the device body. The intermediate side wall portion is substantially non-deformable in response to deformation of the tip portion. In the preferred embodiment, this is achieved by providing the intermediate side wall portions with an outwardly convex shape. With this arrangement, a fixed volume lower vacuum chamber is formed over the clitoris of the user in a simple manner that prevents pinching or compression of the clitoris. Furthermore, with this arrangement, the device may be of unitary construction, manufactured from a single, soft, compressible material, yet possess both deformable and non-deformable portions. The soft, yet functionally non-deformable, lower chamber and flange will further minimize tissue injury from compression or pressure necrosis.

Figure 1B:
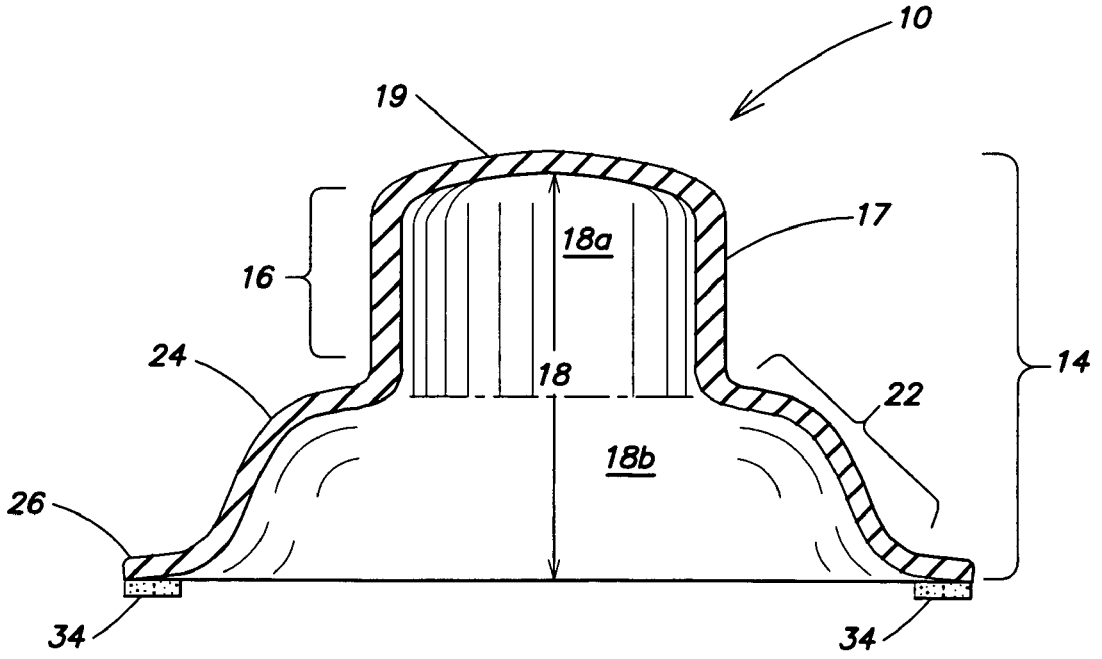
FIG. 1B is a cross-sectional side view of the device of FIG. 1A.

Referring now to FIGS. 1A and 1B, a female stimulation device 10 includes a device body 14 having a tip portion 16 distal from the user's body, a flange 26 and a substantially non-deformable intermediate side wall portion 22 extending outwardly from the tip portion to the flange. The device body 14 defines an interior vacuum chamber 18 (as shown in FIG. 1B) extending from the curved outer end wall 19 of the tip portion 16 to the flange 26. The interior vacuum chamber 18 is comprised of two sub-chambers; a deformable vacuum producing upper chamber 18*a* and a functionally non-deformable vacuum reservoir lower chamber 18*b*, which chambers are exposed to one another in use, as will become apparent. The flange 26 includes a body-contacting surface 29.

The tip portion 16 has a substantially circular shape with vertical walls 17 and a curved outer end wall 19 which serves as a gripping portion to facilitate application and removal of the device in the manner described below. In an alternate embodiment, the outer end wall 19 of the tip portion 16 is flat. The interior of the tip portion 16 defines the upper vacuum chamber 18*a*. The tip portion 16 is at least partially deformable, or compressible, in order to produce a partial vacuum within the interior vacuum chamber 18 sufficient to seal the device 10 to the user's body by the differential in air pressure between the air within the vacuum chamber 18 and the atmospheric air pressure.

Figure 1C:
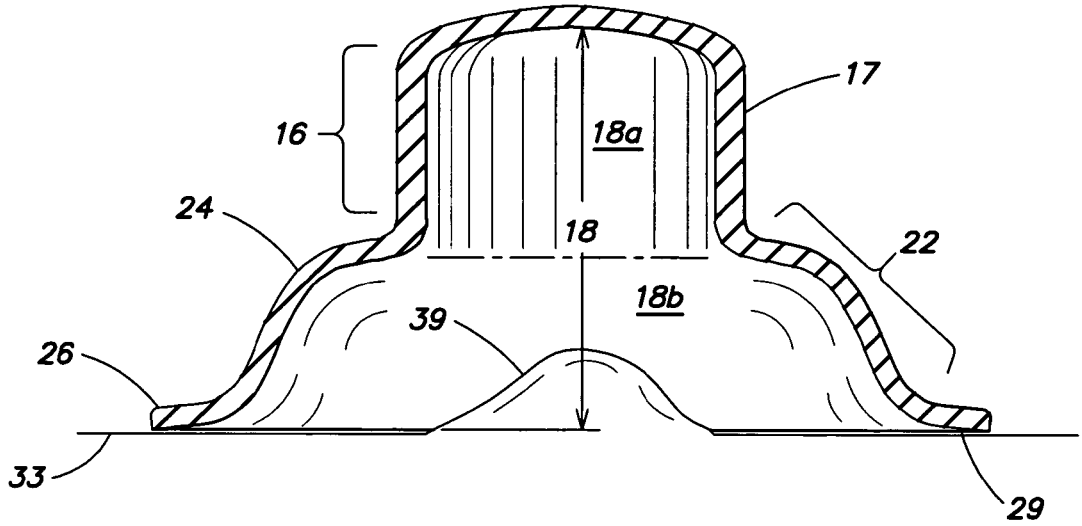
FIG. 1C is a cross-sectional side view of the device of FIG. 1B positioned over the clitoris of a user, but not in use since no vacuum environment exists.
Figure 1D:
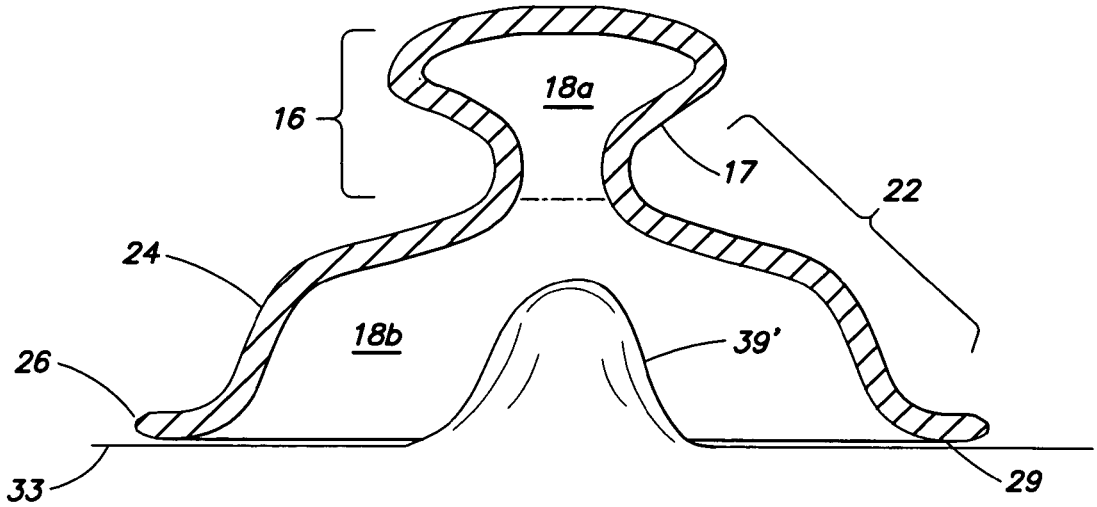
FIG. 1D is a cross-sectional side view of the device of FIG. 1B positioned over the clitoris of a user in use

The intermediate side wall portion 22 extends outwardly from the bottom of the tip portion 16 to the flange 26. The interior of the intermediate side wall portion 22 forms the lower vacuum chamber 18*b*. The intermediate side wall portion 22 is designed so as to avoid compression of the clitoris. In the illustrative embodiment, the intermediate side wall portion is substantially non-deformable and maintains its shape when vacuum is applied by compression of the tip portion (as shown in FIGS. 1C and 1D). Thus, the volume of the lower vacuum chamber 18*b* is substantially constant. In a preferred embodiment, the intermediate side wall portion 22 is outwardly convex. With this arrangement, the intermediate side walls 24 are prevented from folding inward and abutting when vacuum is applied. This, in turn, prevents pinching or compression of the clitoris which is positioned within the lower vacuum chamber 18*b* (FIG. 1D). In a further embodiment, the non-deformable aspect of the intermediate side wall portion can be reinforced by a plurality of projections which extend along at least a portion of an outer surface of the intermediate side walls. The projections may function as reinforcing arches to enhance the resistance of the intermediate side wall portion to deformation in response to deformation of the tip portion.

As noted above and illustrated in FIGS. 1A–1D, body-contacting surface 29 of the flange 26 forms a continuous seal around the clitoris of the user. The seal may be enhanced with the use of a material 34 applied to the body-contacting surface 29 of the flange 26. The material 34 may include a biocompatible adhesive material, a non-adhesive lubricant (for example, water-based gels, petroleum-based gels, or hydrophilic, water-soluble polymers, and the like), and/or pharmacologically active materials such as vasoactive agents. When applied in this manner, vasoactive agents may dilate blood vessels and increase clitoral blood flow. These materials include, but are not limited to: 1. vasoactive agents, both natural and synthetic, that act as vasodilators such as prostaglandins, endothelial-derived relaxation factors, vasoactive interstitial polypeptide agonists, smooth muscle relaxants, leukotriene inhibitors, L-arginine, and others; and 2. Medications and substances that increase clitoral stimulation such as estrogen, methyl testosterone, and apomorphine. The amount of material 34, in the form of a lubricant and/or pharmacologically active material, should be less than about 3 mm thickness on surface 29 to avoid device slippage.

The material 34, in the form of an adhesive, lubricant, and/or vasoactive substance, may be pre-coated onto only a portion or onto the entire body-contacting surface 29. In another embodiment, the lubricant or vasoactive substance may be stored within the tip portion 16 and spread onto the body-contacting surface 29 of the flange 26 when the user squeezes the vertical walls of the tip 17. In yet another embodiment, material 34 may be stored within intermediate side walls 24 for contact with tissue 39. If a lubricant or vasoactive substance is used, the amount disposed on the body-contacting surface 29 should be less than about 3 mm thickness since clinical studies have demonstrated that excessive amounts will over-lubricate the genital area and may subsequently cause device slippage. The material 34, in the form of an adhesive, lubricant, and/or vasoactive substance, may be covered by a thin layer of another material or coating (not shown). This material or coating may be used in packaging or application, to prevent material 34 from dissipating, migrating or drying. This material or coating layer would be removed prior to application. In one embodiment, the material or coating covers only body-contacting surface 29 of flange 26. In yet another embodiment, the material or coating may envelop flange sides 28, the non-body-contacting flange surface 27, or other portions of device 10. Furthermore, the adhesive, lubricant, and/or vasoactive substance may have a fragrant odor and/or pleasant taste so as to increase the arousal of the user or her partner.

Typically, device 10 is constructed of any resilient material that is at least partially deformable. The material should be suitable for application to the human body in the manner described. Such materials include silicone, thermoplastic elastomers, urethanes, or rubber materials. One particularly effective material for use in constructing device 10 has been found to be silicone rubber. Preferably, 30–60-durometer silicone rubber is effective. Most preferably, 40-durometer silicone rubber has been shown to be effective. It will be appreciated that although intermediate side walls 24 are comprised of a resilient, deformable material, the side walls are made substantially non-deformable in response to deformation of tip portion 16 by their geometry, which is outwardly convex in one embodiment. With this arrangement, the device may be of unitary construction and manufactured from a single, soft, deformable material, yet possess both deformable and non-deformable portions. In other words, the lower chamber may be formed from a soft material, yet be functionally non-deformable when vacuum is applied. Furthermore, the resilient, deformable material is generally soft in contacting area tissue. Therefore, the lower chamber and flange will minimize pressure necrosis and any potential damage to genital tissue when compared to rigid, non-deformable materials. As will be further appreciated, other manners of rendering the side walls substantially non-deformable in response to deformation of the tip portion are possible including, but not limited to, material selection, geometry, dimensions and reinforcing features.

In general, device dimensions are dictated by the typical female anatomy so as to comfortably fit over the clitoris within the anterior vaginal vestibule. In the preferred embodiment, the outer radii extending from the center of device 10 to the ends of intermediate side wall portion 22 may vary between about 0.50 cm and about 1.75 cm. The radii of tip portion 16 will vary in proportion to the dimensions stated above, but generally will be between about 0.25 cm and about 0.75 cm, respectively. Preferably, body-contacting surface 29 of flange 26 contacts vaginal tissue adjacent to the outer perimeter of the clitoris. With this arrangement, the efficacy of the device is enhanced by providing a focused vacuum area. The height of device 10 can also vary, but should comfortably fit within the anterior vaginal vestibule without excessive protrusion while also being capable of being accessible for handling. In the preferred embodiment, the height of device 10 is between about 1.5 cm and about 3.0 cm; more preferably, the height of device 10 is between about 2.0 cm and about 2.5 cm; most preferably, the height of device 10 is approximately 2.0 cm. It will be appreciated, however, that the exact dimensions and shape of device 10 can vary without departing from the spirit of the invention.

The vacuum by the device can be controlled by the user. The amount of compression of tip portion 16 of device 10 regulates the amount of negative pressure within internal vacuum chamber 18. If the user compresses tip portion 16 more vigorously, the negative pressure or vacuum increases. In the preferred embodiment, as clinical studies have demonstrated, negative pressures should enhance clitoral blood flow without causing clitoral injury. The studies have demonstrated that to achieve enhanced clitoral blood flow without causing clitoral injury, device 10 should produce a range of negative pressure between about 40 and about 190 mmHg. If negative pressures exceed about 190 mmHg, excessive suction may place users at risk and may result in bleeding, discomfort and tissue injury. Alternatively, negative pressures below about 40 mmHg will result in inadequate stimulation of blood flow to the clitoris, or in failure of the device to self-adhere to the genital area. Device 10, therefore, can be calibrated for its size, shape, and materials of construction to allow for a range of vacuum pressure of between about 40 mmHg and about 190 mmHg.

As noted device 10 may include structures to allow the user to select the most appropriate vacuum level for their need. The various structures may allow users to control the vacuum produced by the device when applied, rather than by the amount of compression of the tip portion 16 by the user. As noted above, based upon clinical studies, a preferred range of the vacuum produced by device 10 can be controlled between about 40 mmHg and about 190 mmHg. Alternatively, a variety of devices may be constructed such that each may have a capability to produce a range of vacuum pressure between about 40 mmHg and about 190 mmHg.

Figure 2A:
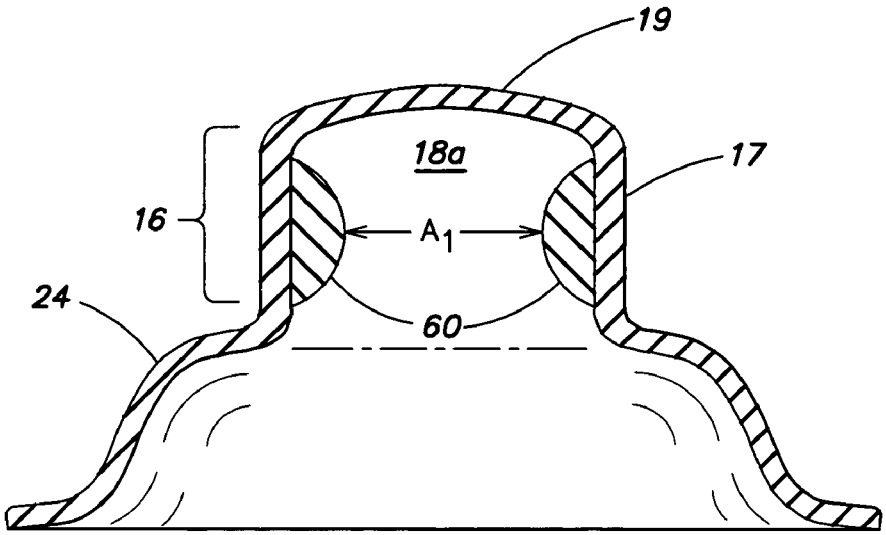
FIG. 2A is a cross-sectional side view of another embodiment of the invention with projections positioned opposite each other within the tip portion.
Figure 2B:
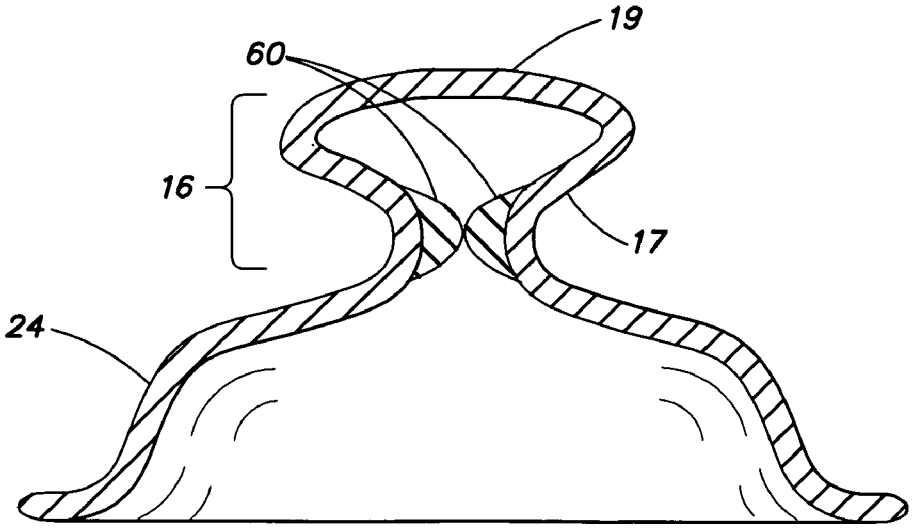
FIG. 2B is a cross-sectional side view of the device of FIG. 2A in use.

One embodiment of device 10 including structures that may allow users to control the vacuum produced when the device is applied is illustrated in FIG. 2A. As shown, non-deformable projections 60 are positioned within inner vacuum chamber 18*a* of tip portion 16. Projections 60 within the tip portion function to restrict tip compression and, therefore, the amount of vacuum produced. In the embodiment shown, two projections 60 are disposed opposite each other within tip portion on an inside portion of walls 17. As shown in FIG. 2B, the user compresses tip portion 16 until projections 60 abut each other at which point further compression cannot occur. The amount of negative pressure generated by device 10 will be directly related to the amount of air displaced in the upper vacuum chamber 18*a* which, in turn, is related to the distance (A1) between the projections (as shown in FIG. 2A). Wall portions 19 and 24 remain substantially in place as tip portion is compressed. The smaller the distance between the projections, the less air displaced upon compression of tip portion 16 and the lower the vacuum generated. Based upon the size of the projections, a range of devices can be constructed so as to create various negative pressures between about 40 mmHg and about 190 mmHg.

Figure 5A:
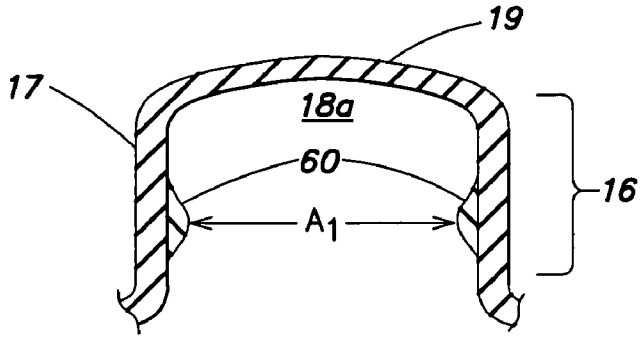
FIG. 5A is a cross-sectional side view of an embodiment of the invention with projections positioned opposite each other within the tip portion.
Figure 5B:
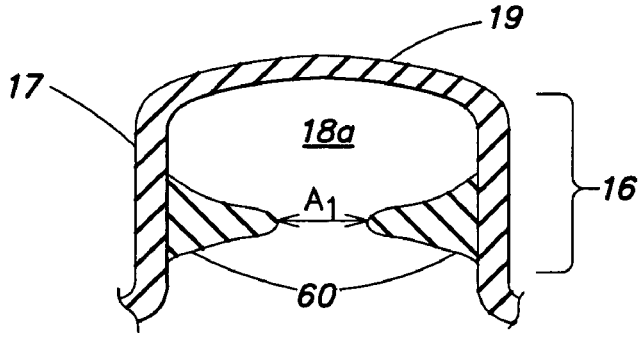
FIG. 5B is a cross-sectional side view of an embodiment of the invention with projections positioned opposite each other within the tip portion.

Referring to FIGS. 5A and 5B, for example, the distance (Al) between projections 60 is greater in the embodiment with smaller projections (FIG. 5A). Therefore, upon compression of tip portion 16, the device in FIG. 5A will displace more air within upper chamber 18*a* and result in greater vacuum compared to the device in FIG. 5B. The user may choose the most appropriate device based upon which vacuum levels works best. As one can appreciate, the geometry, size and number of projections can vary.

Figure 5C:
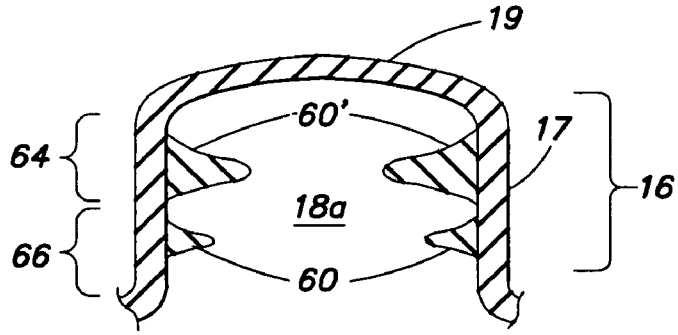
FIG. 5C is a cross-sectional side view of an embodiment of the invention with a plurality of projections positioned opposite each other within the tip portion.

Referring to FIG. 5C, tip portion 16 has a plurality of projections 60 and 60' positioned within the upper vacuum chamber 18*a*. In this embodiment, the user may compress the upper aspect of the tip portion 64 if she prefers less vacuum and the lower aspect of the tip portion 66 if she prefers more vacuum. This embodiment has the advantage of having variable vacuum levels within the same device.

Figure 2C:
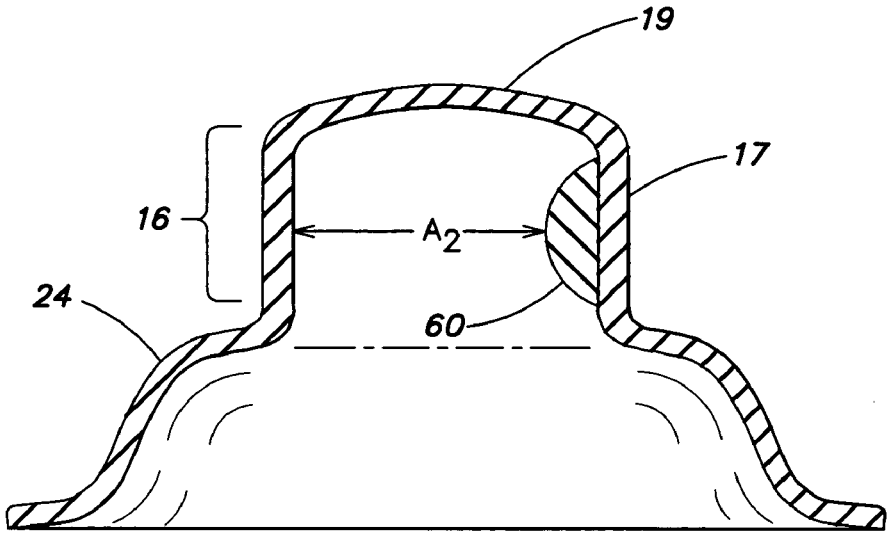
FIG. 2C is a cross-sectional side view of another embodiment of the invention with a projection positioned within the tip portion.
Figure 2D:
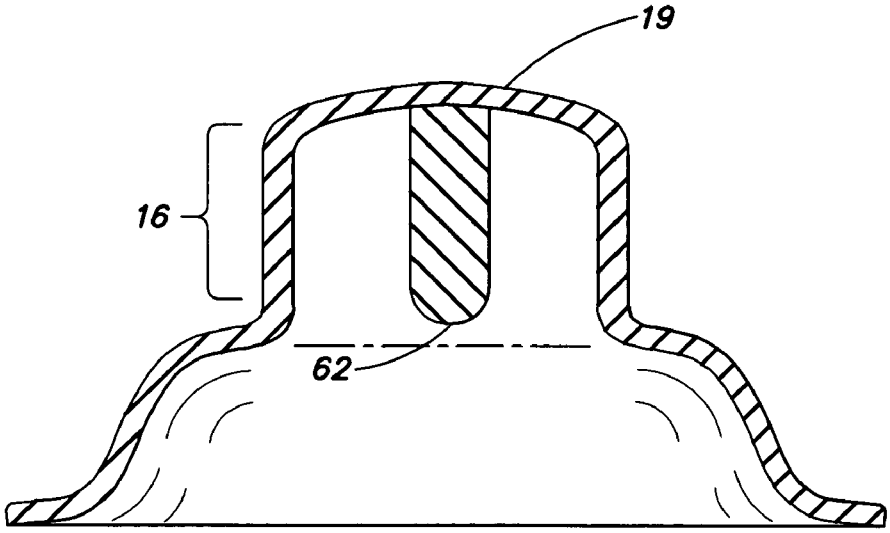
FIG. 2D is a cross-sectional side view of another embodiment of the invention with a projection positioned within the tip portion.
Figure 2E:
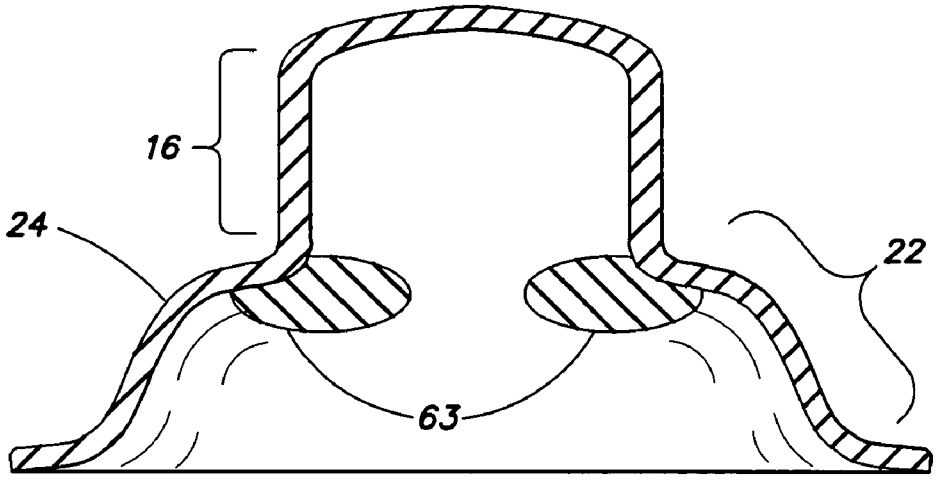
FIG. 2E is a cross-sectional side view of another embodiment of the invention with a cap positioned around the tip portion.

In an alternative embodiment, shown in FIG. 2C, a single non-deformable projection 60 can be disposed within tip portion on an inside portion of wall 17. Projection can be used to limit the amount of negative pressure generated by device 10 in proportion to the distance (A2) between the projection and wall 17. Another embodiment utilizing a non-deformable projection 62 within tip portion 16 is illustrated in FIG. 2D. In this embodiment, projection 62 is positioned on an inside portion of wall 19. In another embodiment, shown in FIG. 2E, projections 63 are disposed within intermediate side wall portion 22. In this embodiment, non-deformable projections 63 are positioned on an upper inside portion of wall 24 and can serve to limit the amount of negative pressure generated by the device by limiting the distance available to compress the tip portion 16.

Figure 2F:
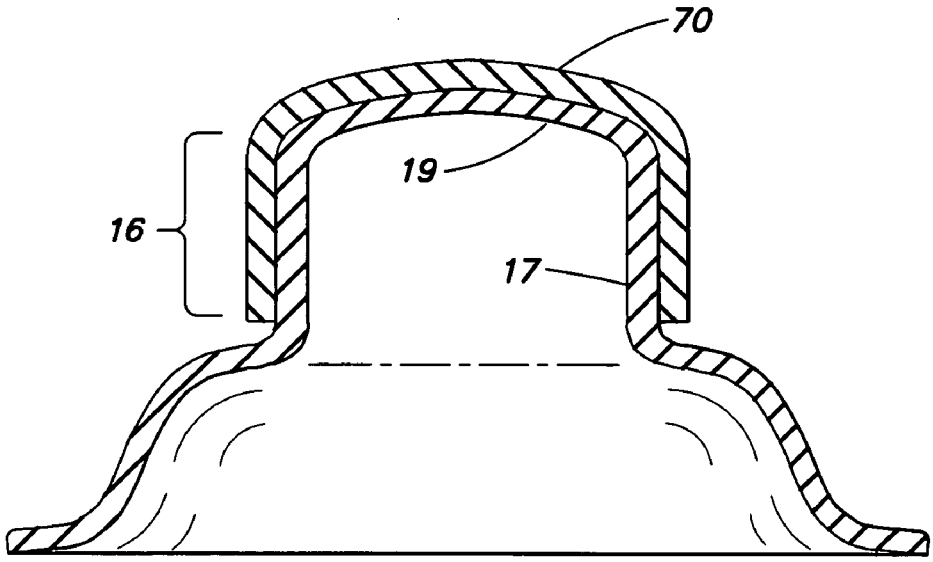
FIG. 2F is a cross-sectional side view of another embodiment of the invention with a cap positioned around the tip portion.
Figure 2G:
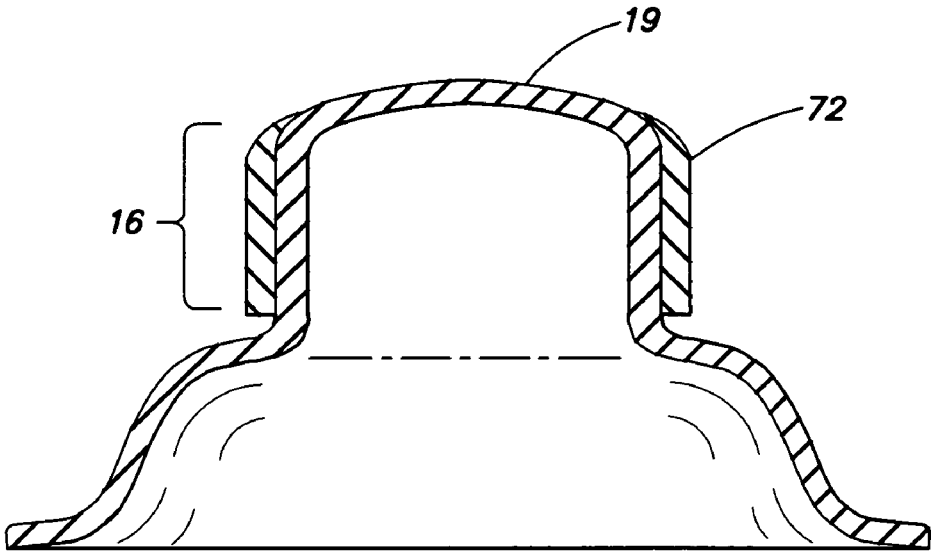
FIG. 2G is a cross-sectional side view of another embodiment of the invention with a cap positioned around a portion of the tip portion.

An alternative approach to limiting the compression of tip portion 16 and, therefore, the resulting negative pressure produced by the device is illustrated in FIG. 2F and FIG. 2G. As shown in FIG. 2F, a cover, or cap element 70 can be placed over tip portion 16. Element 70 may be positioned around walls 17 and 19, and be formed of a compatible material that serves to limit the compressibility of tip portion, thereby controlling the amount of air displacement and reducing the vacuum generated by device 10. Likewise, as shown in FIG. 2G, a cover, or ring element 72 may be positioned around tip portion 16 adjacent wall 17 to limit the compressibility of tip portion.

Figure 2H:
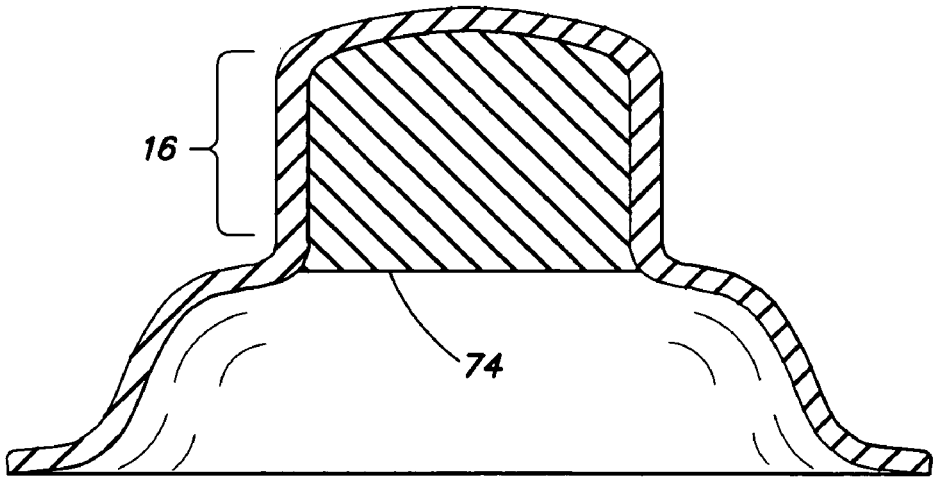
FIG. 2H is a cross-sectional side view of another embodiment of the invention with an elastomeric material positioned within the tip portion.

Another embodiment of device, shown in FIG. 2H, utilizes an elastomeric material 74 disposed within tip portion 16. Material 74 may be formed from any material that is compatible with device 10, which would restrict the compressibility of tip portion 16.

Figure 4A:
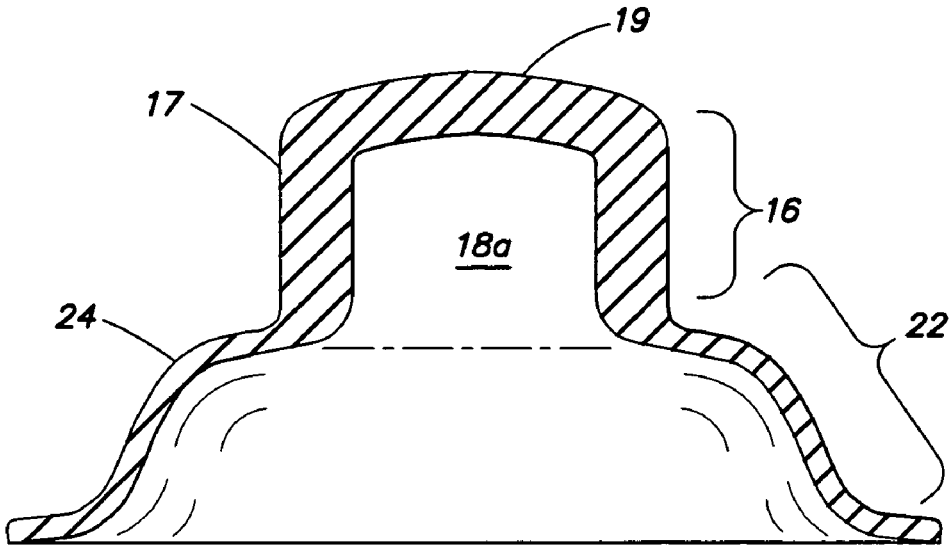
FIG. 4A is a cross-sectional side view of an embodiment of the invention wherein the tip portion has thicker walls than the intermediate side wall portion.
Figure 4B:
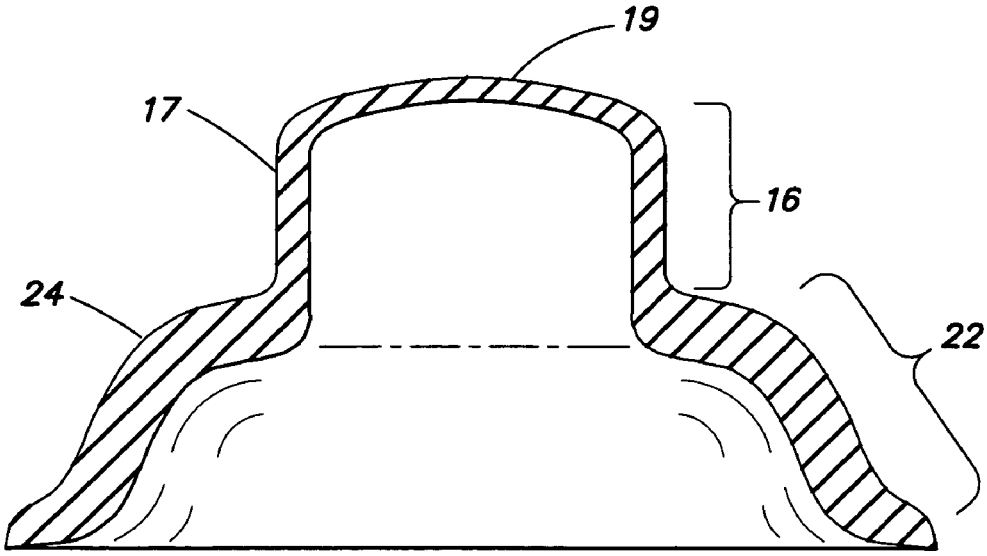
FIG. 4B is a cross-sectional side view of an embodiment of the invention wherein the intermediate side wall portion has thicker walls than the tip portion.

The vacuum produced by the device may also be controlled by providing tip portion 16 and intermediate side wall portion 22 with walls of different thicknesses. Despite use of a resilient, deformable material, variation in wall thickness can change compression of tip portion and the resultant vacuum as shown in FIGS. 4A and 4B.

Figure 6:
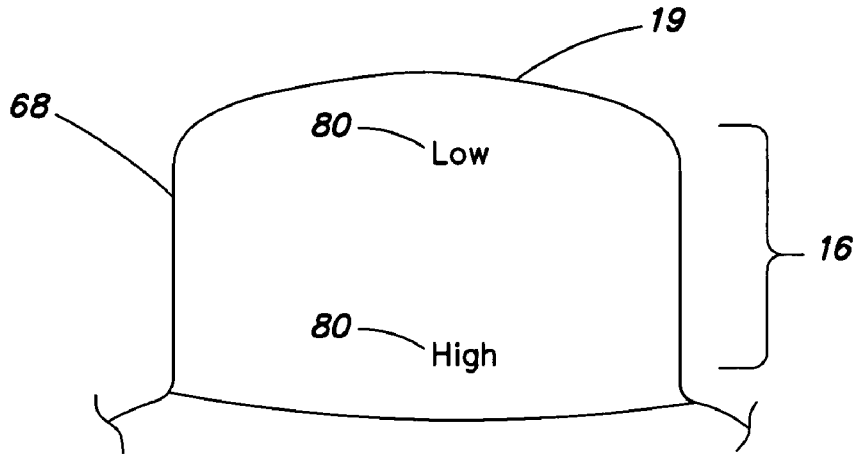
FIG. 6 is a cross-sectional side view of an embodiment of the invention wherein the tip portion includes exemplary indicia positioned on an outer wall.

Referring to FIG. 6, in another embodiment the outside surface of tip portion 16 includes indicia 80. The indicia 80, shown in the form of markings or labels, instruct the user where to place her fingers when compressing the device. In the preferred embodiment, indicia 80 would include the word "Low" near the top of outer end wall 19, and "High" near base 68 of tip portion 16. It is to be appreciated that other suitable indicia may be used to instruct the user in controlling the vacuum of the device. When the user compresses the region marked "Low," the inherent stiffness of wall 19 of tip portion prevents full compression and, therefore, less vacuum compared to compression of the region marked "High" Indicia 80 may be used in conjunction with the embodiment described above, with reference to FIG. 5C. The "Low" label would be placed over the larger projections, while the "High" label would be placed over the smaller projections. As one can appreciate, indicia 80 can vary without affecting the function of the device. Indicia, for example, may include numbers, letters, or any other markings to provide users with instruction.

Figure 3A:
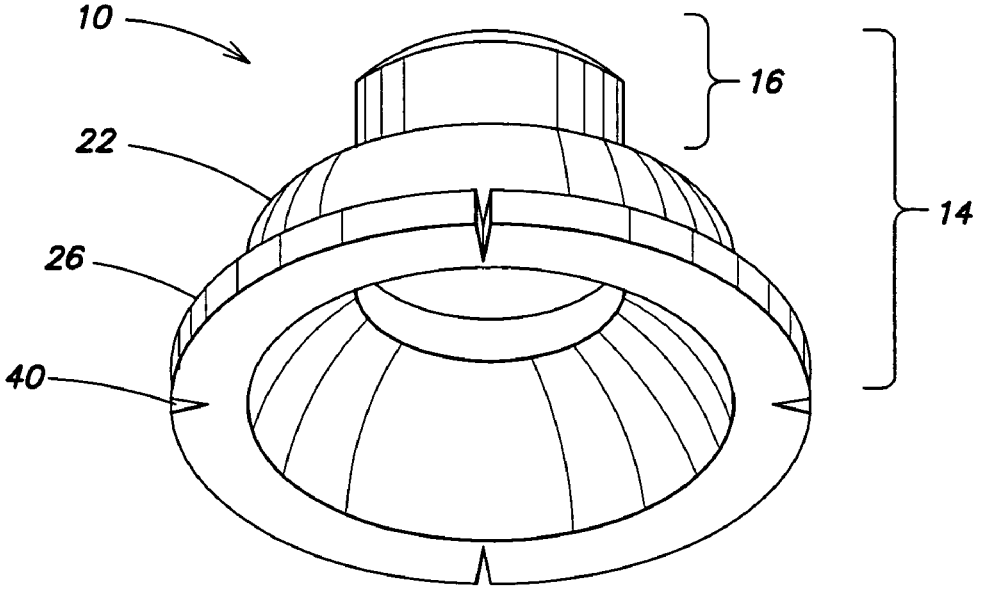
FIG. 3A is a bottom perspective of a female stimulation device constructed of low tear strength material and possessing a plurality of small slits on the flange.
Figure 3B:
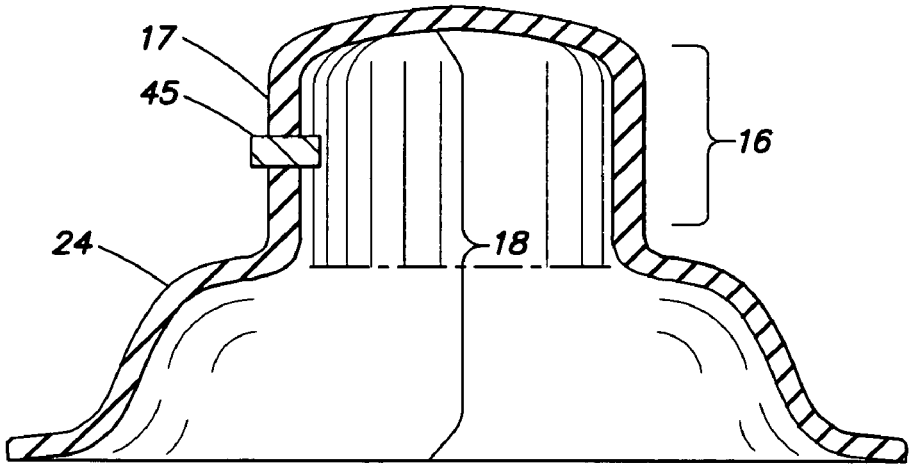
FIG. 3B is a cross sectional side view of an embodiment of the invention possessing a water soluble plug embedded in the wall.
Figure 3C:
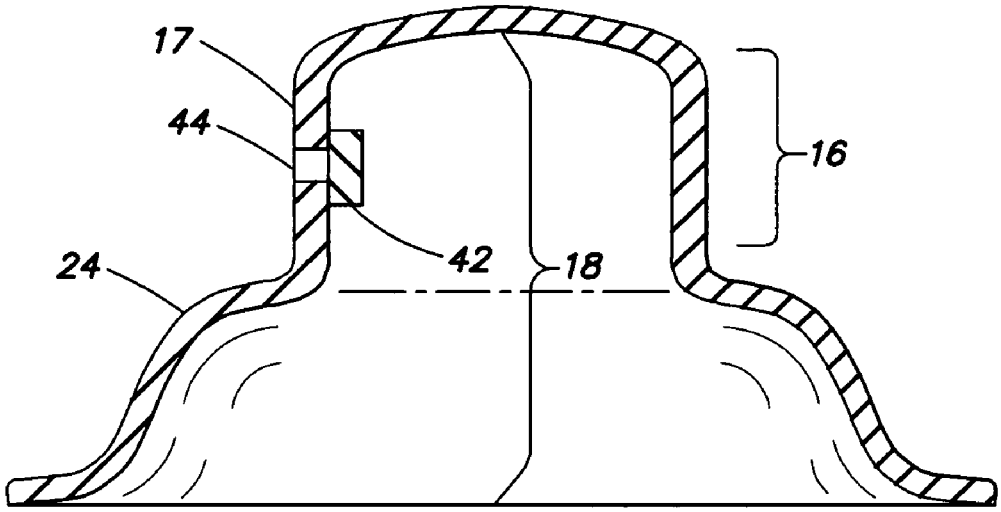
FIG. 3C is a cross-sectional side view of an embodiment of the invention possessing a patch of material on the inner aspect of the tip portion.

The device 10 can be made disposable or for limited reuse for safety by avoiding infection or contamination from excessive use or misuse. The device may be constructed from a low-tear strength material such as silicone, thermoplastic elastomers, urethane, and rubbers. The low-tear strength materials permit device 10 to easily tear apart after one to several applications. Referring to FIG. 3A, to further increase the disposability of the low-tear strength material, a plurality of slits 40 can be placed along flange 26 to allow device body 14 to tear easily. Referring to FIG. 3B, in another embodiment, the device may include a biodegradable plug 45 imbedded in wall 17 of the device. Upon contact with moist vaginal tissue, plug 45 would degrade, thereby creating an open channel between interior vacuum chamber 18 and the outside. In a similar manner, referring to FIG. 3C, device 10 may include a patch of material 42 covering a hole 44 in wall 17. The material is attached to wall 17 by an adhesive (not shown). The material 42 will tear away after one or several applications; thereby destroying the device's vacuum. The patch of material 42 may be attached on the inner or outer surface of either the tip portion 16 or the intermediate side wall portion 22. One or more patches of material can be used. In yet another embodiment, a region of the intermediate side wall 24 or vertical walls 17 is made extremely thin so as to rupture upon multiple uses. Another embodiment to aid the user in determining when to discard or replace the device includes color changes associated with wear over time.

Referring also to FIGS. 1C–1D, the method of application of device 10 to the user's body is described. The user compresses tip portion 16, thereby deforming the tip portion and reducing the air column within the entire interior vacuum chamber 18. The device 10 is then comfortably fitted over the clitoris 39, with body-contacting surface 29 of flange 26 placed in contact with the anterior vaginal vault tissue surrounding clitoris 39. Tip portion 16 is then released, permitting the device to expand to its original shape. The restorative deformation of tip portion 16 causes at least a partial vacuum to be provided within interior vacuum chamber 18. The vacuum environment serves to produce clitoral engorgement 39 and increased sexual arousal while also serving to maintain device 10 in reliable sealed engagement with the user. The surrounding labial folds further secure device 10 to the clitoris 39' and within the anterior vaginal vestibule 33. In this fashion, the labial folds both cover device 10 and prevent device migration. The user may now discreetly wear device 10 as she performs her daily tasks without further self-manipulation or embarrassment.

The deformation of tip portion 16 reduces the air volume within the entire interior vacuum chamber 18 and produces a partial vacuum. The force created by the differential pressure between the outside atmosphere pressure and the pressure within the interior vacuum chamber will attempt to force intermediate side walls 24 inward toward the center of the vacuum chamber. If intermediate side walls 24 were deformable (e.g., flat or concave inward), sufficient vacuum applied to interior vacuum chamber 18 would cause intermediate side walls 24 to collapse inward toward or into an abutting relationship. In this case, the normally distensible clitoris 39 would be drawn into the compromised interior vacuum chamber 18 and compressed by the abutting intermediate side walls 24. Clitoral tissue could become entrapped and pinched by these abutting side walls 24. In the preferred embodiment, side walls 24 are shaped outwardly convex, like an arch, preventing inward movement of intermediate side walls 24 and thereby preventing clitoral entrapment and/or compression.

More precisely, the outwardly convex geometry of intermediate side walls 24 creates two functional chambers 18*a* and 18*b* which resemble a "bell." The lower vacuum chamber 18*b*, formed by the outwardly convex intermediate walls, serves as a substantially non-deformable, constant volume vacuum reservoir, while upper vacuum chamber 18*a*, formed by the tip portion, serves to create the vacuum due to its side wall deformation. In this fashion, lower vacuum chamber 18*b* evenly distributes suction to the clitoral tissue without compressing, obstructing or pinching clitoral tissue. Stated differently, the outwardly convex wall geometry allows the device to be of unitary construction and manufactured from a single, soft, deformable material. The lower vacuum chamber 18*b* may be composed of a soft, deformable material, yet be functionally non-deformable when vacuum is applied. Furthermore, the soft deformable material composing the non-deformable lower chamber and flange will minimize pressure necrosis to genital tissues when compared to rigid non-deformable materials, thus further preventing tissue damage.

As noted above, the user can alter the amount of vacuum in the interior vacuum chamber 18 by varying the degree of compression of the tip portion and thus the amount of air that is displaced. The greater the amount of manual compression to the tip portion, the greater the amount of displaced air and subsequent vacuum. In this manner, the user can advantageously regulate the amount of clitoral suction in order to generate a physiological response, rather than rely upon predetermined vacuum from an external vacuum source. The amount of vacuum necessary to stimulate female sexual arousal may vary depending upon the user and her pre-excitatory state but is preferable between about 40 mmHg and about 190 mmHg. Clinical testing has demonstrated that this negative pressure range maximizes clitoral blood flow without causing discomfort, bleeding and tissue injury.

To achieve an optimal response, clinical testing has shown that the device should initially be utilized for a period of time to condition the genital tissues also known as a "conditioning period." Users should apply the device for a specified period of time; up to as long as several weeks; preferably one to four weeks. The device should be applied on a daily basis for a predetermined period; for as long as approximately thirty minutes. This "conditioning period" is important to stimulate blood flow to the genital tissues. Once the "conditioning period" is complete, and additional blood flow has been stimulated, the user then applies the device only before vaginal sex. In the preferred method, the user applies the device approximately thirty minutes before engaging in vaginal sex to acutely increase blood flow and enhance sexual arousal. The user removes the device before vaginal sex.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. For example, the device may further include additional structures and elements to increase or enhance clitoral blood flow and stimulation. Such structures may include mechanical attachments secured to the device to contact the clitoral tissue without compressing, obstructing or pinching. Another embodiment may include vibratory devices secured to a portion of device body, and electronically or mechanically operated to enhance clitoral blood flow. Another embodiment may include the use of a heat-producing compound on a surface-contacting portion of the device to stimulate the user. All of these supplemental-structures may be used in combination with the vacuum producing device to increase the overall efficiency of the device and enhance stimulation of the user. Accordingly, the foregoing description and drawings are by way of example only.

What is claimed is:

1. A female stimulation device comprising:

a device body having a tip portion, a flange, and an intermediate side wall portion extending from said tip portion to said flange; and means for controlling vacuum produced by said device when applied to a user;

wherein said flange is sized and shaped to encompass the female clitoris, said tip portion is deformable and defines a vacuum producing upper chamber, said intermediate side wall portion is outwardly convex and defines a vacuum reservoir lower chamber, and said lower chamber portion is non-deformable.

2. The device as claimed in claim 1, wherein said device body is constructed from a resilient material.

3. The device as claimed in claim 1, wherein a material selected from the group consisting of an adhesive, a lubricant, a vasoactive substance, and mixtures thereof is disposed on a portion of said flange.

4. The device as claimed in claim 3, wherein said material has a thickness of less than about 3 mm.

5. The device as claimed in claim 4, wherein a coating is placed on top of said material.

6. The device as claimed in claim 3, wherein a material selected from the group consisting of a lubricant, a vasoactive substance, and mixtures thereof is disposed on an inside wall of said tip portion.

7. The device as claimed in claim 1, wherein said vacuum producing upper chamber produces vacuum to promote clitoral blood flow without causing injury to underlying tissue.

8. The device as claimed in claim 7, wherein said vacuum producing upper chamber produces a vacuum of between about 40 and about 190 mmHg.

9. The device as claimed in claim 1, wherein said means for controlling vacuum comprises at least one projection disposed within said tip portion.

10. The device as claimed in claim 9, wherein said at least one projection is disposed on an inside wall of said tip portion.

11. The device as claimed in claim 4, wherein said means for controlling vacuum comprises at least one projection disposed inside said vacuum reservoir lower chamber.

12. The device as claimed in claim 1, wherein said means for controlling vacuum includes indicia positioned on an outer wall of said device body.

13. The device as claimed in claim 1, wherein said means for controlling vacuum comprises a cover positioned on a portion of an outer wall of said tip portion.

14. The device as claimed in claim 1, wherein said means for controlling vacuum comprises said tip portion and said intermediate side wall portion having walls of different thicknesses.

15. The device as claimed in claim 14 wherein said intermediate side wall portion has thicker walls than said tip portion.

16. The device as claimed in claim 14, wherein said tip portion has thicker walls than said intermediate side wall portion.

17. The device as claimed in claim 1, wherein said means for controlling vacuum comprises an elastomeric material disposed within said tip portion.

18. The device as claimed in claim 1, wherein said device is constructed from low-tear strength material.

19. The device as claimed in claim 18, further comprising a plurality of slits placed along said flange.

20. The device as claimed in claim 1, further comprising a biodegradable plug positioned in an outer wall of said device body.

21. The device as claimed in claim 1, further comprising a patch of material positioned over a hole in an outer wall of said device body.

22. The device as claimed in claim 1, wherein an outer wall of said device body includes a portion having a thickness that is less than the rest of the body.

23. A method for facilitating female stimulation, comprising:

providing a device comprising a tip portion, a flange, and an intermediate side wall portion extending outwardly from said tip portion to said flange, wherein said flange is sized and shaped to encompass the female clitoris, said intermediate side wall portion is outwardly convex and defines a vacuum reservoir lower chamber, said tip portion is deformable and defines a vacuum producing upper chamber that produces vacuum levels of between about 40 and about 190 mmHg in said lower chamber, and said lower chamber portion is non-deformable; and providing instruction to apply said device to promote clitoral blood flow without causing injury to underlying tissue.

24. he method of claim 23, further comprising providing a material selected from the group consisting of an adhesive, a lubricant, a vasoactive substance, and mixtures thereof.

25. The method of claim 24, further comprising providing instructions to apply said material on a portion of said flange prior to applying said device.

26. The method of claim 23, wherein said vacuum producing upper chamber comprises means for controlling vacuum produced.

27. The method of claim 26, wherein said means for controlling vacuum comprises at least one projection disposed within said tip portion.

28. The method of claim 27, wherein said at least one projection is disposed on an inside wall of said tip portion.

29. The method of claim 26, wherein said means for controlling vacuum comprises at least one projection disposed inside said vacuum reservoir lower chamber.

30. The method of claim 26, wherein said means for controlling vacuum comprises indicia positioned on an outer wall of said device.

31. The method of claim 26, wherein said means for controlling vacuum comprises a cover positioned on a portion of an outer wall of said tip portion.

32. The method of claim 26, wherein said means for controlling vacuum comprises said tip portion and said intermediate side wall portion having walls of different thicknesses.

33. The method of claim 26, wherein said means for controlling vacuum comprises an elastomeric material disposed within said tip portion.

34. The method of claim 23, wherein said device is constructed from low-tear strength material.

35. The method of claim 34, wherein said device further comprises a plurality of slits placed along said flange.

36. The method of claim 23, wherein said device further comprises a biodegradable plug positioned in an outer wall of said device.

37. The method of claim 23, wherein said device further comprises a patch of material positioned over a hole in an outer wall of said device.

38. The method of claim 23, wherein an outer wall of said device includes a portion having a thickness that is less than the rest of the body.

39. A method for enhancing female stimulation, comprising the steps of: providing a female stimulation device comprising a tip portion, a flange, and an intermediate side wall portion extending from said tip portion to said flange and defining an interior vacuum chamber;

compressing said tip portion to reduce an air column formed within said interior vacuum chamber;

placing said device over the female clitoris such that said flange is placed into contact with anterior vaginal vault tissue;

releasing said tip portion to produce vacuum levels of between about 40 and about 190 mmHg in said interior vacuum chamber, wherein said vacuum causes clitoral engorgement and maintains engagement of said device with said anterior vaginal vault tissue; and removing said device after a predetermined period of time.

40. The method of claim 39, further comprising:

repeating said steps periodically to condition genital tissues.

41. The method of claim 40, wherein said genital tissues are conditioned by applying said device for up to 30 minutes daily for between about 1 and about 4 weeks.

42. The method of claim 41, further comprising, applying a material selected from the group consisting of an adhesive, a lubricant, a vasoactive substance, and mixtures thereof on a portion of said flange prior to placing said device into contact with said anterior vaginal vault tissue.

43. The method of claim 39, further comprising:

controlling the compression of said tip portion and the resulting vacuum levels produced in said interior vacuum chamber.

44. The method of claim 39, wherein said device further comprises means for controlling vacuum produced.

45. The method of claim 44, wherein said means for controlling vacuum comprises at least one projection disposed within said tip portion.

46. The method of claim 45, wherein said at least one projection is disposed on an inside wall of said tip portion.

47. The method of claim 44, wherein said means for controlling vacuum comprises at least one projection disposed inside said interior vacuum chamber.

48. The method of claim 44, wherein said means for controlling vacuum comprises indicia positioned on an outer wall of said device.

49. The method of claim 44, wherein said means for controlling vacuum comprises a cover positioned on a portion of an outer wall of said tip portion.

50. The method of claim 44, wherein said means for controlling vacuum comprises said tip portion and said intermediate side wall portion having walls of different thicknesses.

51. The method of claim 44, wherein said means for controlling vacuum comprises an elastomeric material disposed within said tip portion.

52. The method of claim 39, wherein said device is constructed from low-tear strength material.

53. The method of claim 52, wherein said device further comprises a plurality of slits placed along said flange.

54. The method of claim 39, wherein said device further comprises a biodegradable plug positioned in an outer wall of said device.

55. The method of claim 39, wherein said device further comprises a patch of material positioned over a hole in an outer wall of said device.

56. The method of claim 39, wherein an outer wall of said device includes a portion having a thickness that is less than the rest of the body.

* * * * *